United States Patent [19]

Murakami et al.

[11] Patent Number: 4,741,237

[45] Date of Patent: May 3, 1988

[54] ACTUATOR FOR AUTOMATIC PERFORMANCE PIANO

[75] Inventors: Kazuo Murakami; Toshio Tajima, both of Hamamatsu, Japan

[73] Assignee: Nippon Gakki Seizo Kabushiki Kaisha, Hamamatsu, Japan

[21] Appl. No.: 25,287

[22] Filed: Mar. 12, 1987

[30] Foreign Application Priority Data

| | | | |
|---|---|---|---|
| Mar. 14, 1986 | [JP] | Japan | 61-55042 |
| Mar. 14, 1986 | [JP] | Japan | 61-36266[U] |
| Mar. 14, 1986 | [JP] | Japan | 61-36267[U] |
| Mar. 14, 1986 | [JP] | Japan | 61-36269[U] |
| Mar. 14, 1986 | [JP] | Japan | 61-36270[U] |

[51] Int. Cl.[4] ..... G10C 3/20

[52] U.S. Cl. ..... 84/20

[58] Field of Search ..... 84/19, 20

[56] References Cited

U.S. PATENT DOCUMENTS

| | | | |
|---|---|---|---|
| 784,508 | 3/1905 | Weber | 84/20 |
| 4,031,796 | 6/1977 | Wilkes et al. | 84/20 |
| 4,513,652 | 4/1985 | Muramatsu et al. | 84/20 |

FOREIGN PATENT DOCUMENTS 59-20296 2/1984 Japan .

*Primary Examiner*—Patrick R. Salce
*Assistant Examiner*—Jeffrey Sterrett
*Attorney, Agent, or Firm*—Blakely, Sokoloff, Taylor & Zafman

[57] ABSTRACT

An actuator for an automatic performance piano, includes electromagnetic plunger units provided in correspondence to and adjacent to a plurality of keys of the piano, each of the electromagnetic plunger units having an excitation coil and a plunger, and a key drive portion, provided at the distal end of the plunger for driving the key. The electromagnetic plunger units are arranged along the key arrangement direction to be deviated from each other in the front-back direction of the key in a staggered manner. A motion stroke of the key drive portion of the electromagnetic plunger unit in one row is made smaller than a motion stroke of the key drive portion of the electromagnetic plunger unit in the other row.

14 Claims, 9 Drawing Sheets

ACTUATOR FOR AUTOMATIC PERFORMANCE PIANO

BACKGROUND OF THE INVENTION

The present invention relates to an actuator for an automatic performance piano.

In general, a well-known electromagnetic plunger is used as an actuator for driving keys of an automatic performance piano. The plunger normally includes an excitation coil, a movable iron core movably inserted through a bobbin of the excitation coil, a yoke having the excitation coil therein and forming a magnetic path, and the like. In accordance with an electrical signal reproduced from a recording medium, the plunger is driven to drive a key as if it were depressed by a human hand. A conventional actuator for this type will be described below. An actuator is disposed below the back ends of keys, and is constituted by a substantially U-shaped common yoke extending longitudinally along a direction in which the keys are arranged, and a plurality of electromagnetic plungers disposed inside the common yoke to correspond to the respective keys. The common yoke is made of a magnetic body such as soft iron so as to provide a common magnetic path for the respective electromagnetic plungers. The common yoke is almost horizontally disposed below the back ends of the keys to keep a predetermined interval between a keybed and the keys.

Each electromagnetic plunger includes a bobbin which integrally has a pair of upper and lower flange portions and around which an excitation coil is wound, a stationary yoke disposed at an upper portion inside the bobbin and fitted in a through hole provided at the upper surface of the common yoke, i.e., an upper yoke, and a shaft inserted into an inner hole of the stationary yoke through a guide bush and having a drive button mounted to its upper end and a movable yoke mounted to its lower end. The lower portion of the stationary yoke is formed to have an inverted frustoconical shape. A tapered hole is formed on the upper surface of the movable yoke so as to correspond to the inverted frustoconical shape of the stationary yoke, and a space between the tapered hole and the cone forms a magnetic gap. The movable yoke is slidably inserted into an insertion hole, provided to a lower yoke, and is attracted upward by a magnetic flux effect generated at the magnetic gap when the excitation coil is energized, so that the drive button together with the shaft are moved upwrd to push the back end lower surface of the key. Note that a stopper and buffer felts are also included.

In the actuator having the above structure, when a diameter of the bobbin is larger than a width of the key, portions of the bobbin extend from both sides of the key so that the adjacent bobbins interfere with each other. Therefore, bobbins are generally arranged to be alternately deviated from each other in the front-back direction, i.e., in a staggered manner. However, when the bobbins are arranged in such a staggered manner, a difference occurs in driving forces between front and back electromagnetic plungers, and a performance cannot be faithfully reproduced.

More specifically, when the electromagnetic plungers are horizontally arranged on the keybed to form front and back rows, an interval between the drive button of each electromagnetic plunger in the front row and the lower surface of the key is wider (by about 1.2 mm) than that between the drive button of each electromagnetic plunger in the back row and the lower surface of the key. Therefore, time lag occurs when the keys are driven, and the driving force of the electromagnetic plunger in the back row is larger than that of the electromagnetic plunger in the front row.

The conventional actuator has another problem wherein acceleration of the plunger is considerably large when it pushes the key upwardly. Thus, large impact noise is generated when a key is stricken. Furthermore, in the conventional actuator, it is troublesome and takes a long time to mount the electromagnetic plunger to the mounting plate, resulting in poor assembly workability.

SUMMARY OF THE INVENTION

An actuator for an automatic performance piano according to the present invention has been made to solve the above problems. That is, in an actuator for an automatic performance piano in which a plurality of electromagnetic plungers are disposed to correspond to the respective keys and the plungers are conducted to drive the corresponding keys, the electromagnetic plungers are arranged below the back ends of the keys to be almost parallel to the lower surfaces of the keys in a staggered manner so as to be alternately deviated from each other along the front-back direction of the key, a stroke of the drive button of the electromagnetic plunger group in the front row is made smaller than that of the drive button of the electromagnetic plunger group in the back row, and the top end surface of the drive button of each electromagnetic plunger is almost parallel to the lower end surface of the key.

According to the present invention, a buffer device made of an elastic material is mounted at the distal end of the key drive portion.

Furthermore, an elongated hole is provided along the key arrangement direction and in correspondence to a length of the key array at the back portion of a keybed on which the keys are arranged. A key drive unit having an adjust mechanism which can be moved in the front-back direction, the left-right direction, and vertically, is housed inside the elongated hole. The key drive unit comprises a base bracket, the electromagnetic plunger units arranged and mounted on the base bracket in a staggered manner, and the adjust mechanism which can be moved in the front-back direction, the left-right direction, and vertically.

DESCRIPTION OF THE PREFERRED EMBODIMENT

An embodiment of the present invention will now be described in detail with reference to the accompanying drawings.

Figure 1:
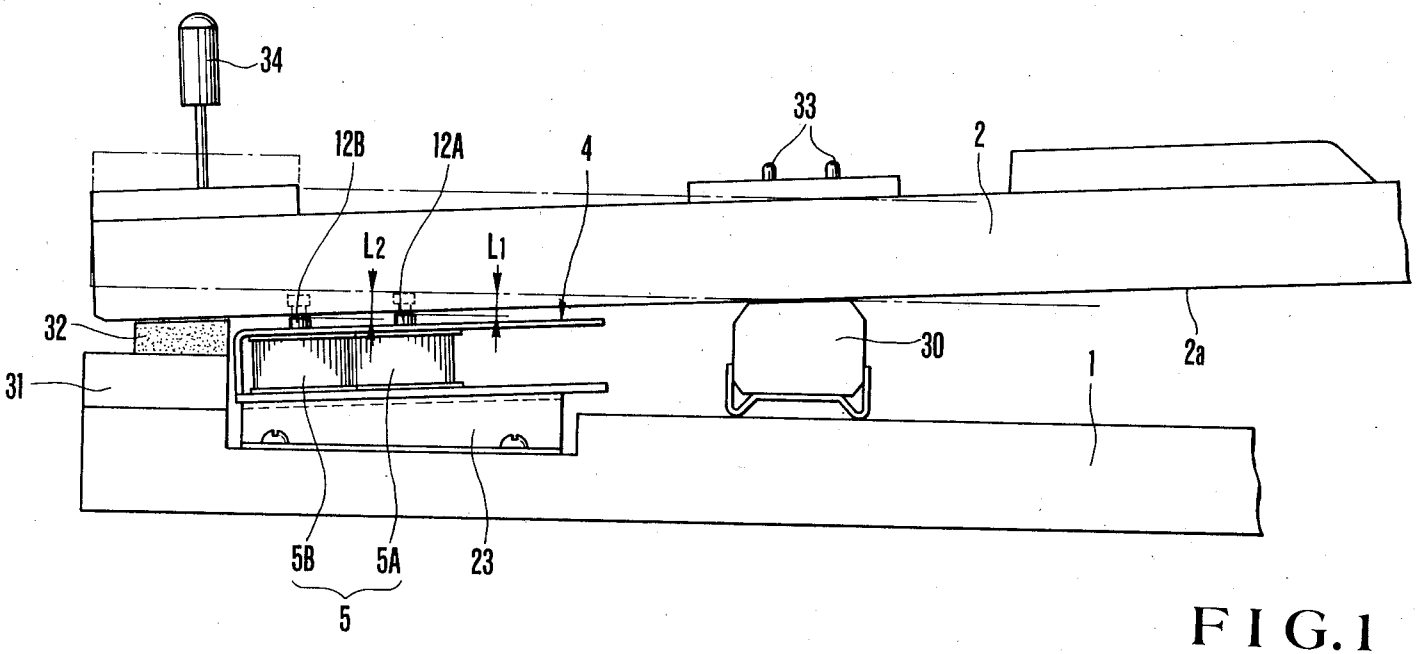
FIG. 1 is a side view of a keyboard portion which incorporates an actuator according to the present invention.
Figure 2:
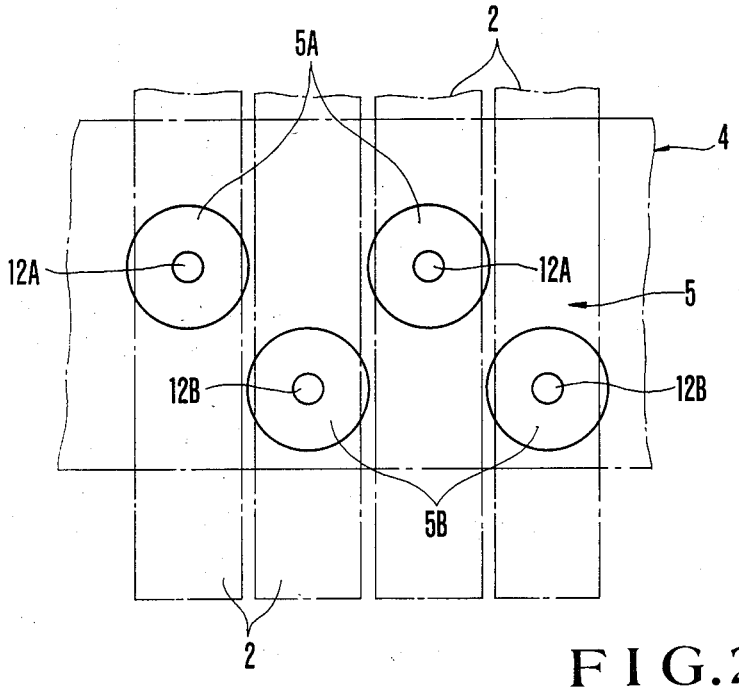
FIG. 2 is a plan view showing an arrangement of electromagnetic plungers.
Figure 3:
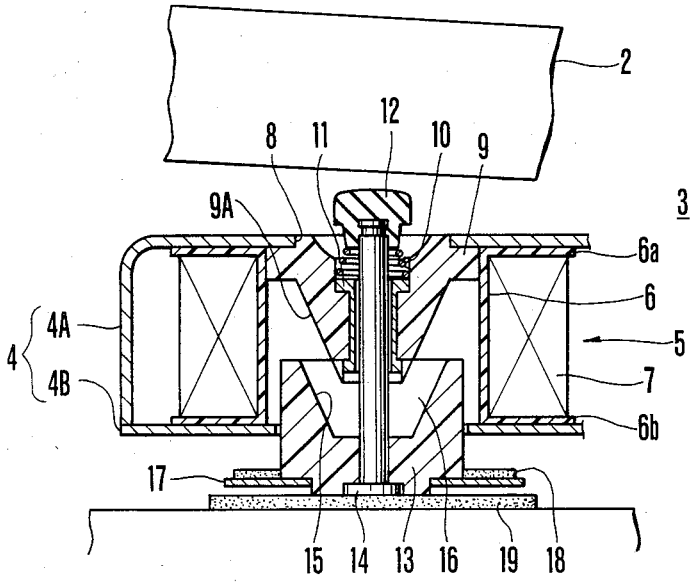
FIG. 3 is a sectional view showing a structure of the actuator.

FIGS. 1 to 3 show an embodiment of an actuator for an automatic performance piano according to the present invention. In FIGS. 1 to 3, a common yoke 4 is substantially U-shaped and extends in common with respect to a plurality of keys 2. The common yoke 4 is disposed on the back end upper surface of a keybed 1 through a bracket 23. The common yoke 4 is disposed to oppose and is parallel to the lower surface 2*a* of the key 2, i.e., disposed with an inclination angle which is substantially the same as that of the key 2 (about 3° with respect to a horizontal line). Inside the common yoke 4, a plurality of electromagnetic plungers 5 which correspond to the respective keys 2 are arranged in a staggered manner in two groups, i.e., the front row electromagnetic plunger group 5A and the back row electromagnetic plunger group 5B.

In this case, since the common yoke 4 is disposed inclined so as to oppose and to be parallel to the lower surface of the key 2 in its rest position, an interval between a drive button 12A of the front row electromagnetic plunger group 5A and the key lower surface 2a is set equal to that between the drive button 12B of the back row electromagnetic plunger group 5B and the key lower surface 2*a*. In addition, since an upward stroke $L_1$ of the drive button 12A close to the front end of the key, i.e., in the front row is set smaller by about 1 to 2 mm than an upward stroke $L_2$ of the drive button 12B close to the back end, i.e., in the back row, uppermost positions of the buttons 12A and 12B are aligned with each other and motion amounts (depths by which the front ends sink) of the keys 2 are set equal to each other. Furthermore, a shaft 14 (see FIG. 3) of each electromagnetic plunger 5 is disposed perpendicular to the key lower surface 2*a* at an initial rest position by the inclination of the common yoke 4, and the top end surface of the drive button 12 opposes and is parallel to the key lower surface 2*a*.

Note that reference numeral 30 denotes a balance rail; 31, a back rail; 32, a felt; 33, a balance key pin; and 34, a capstan.

According to the actuator having the above structure, since the electromagnetic plunger 5 is disposed substantially parallel to the key lower surface 2*a*, the interval between the drive button 12 of the front row plunger 5 and the key lower surface 2*a* can be set equal to that between the drive button 12 of the back row plunger 5 and the key lower surface 2*a*. In addition, since the upward stroke $L_l$ of the drive button 12 of the front row electromagnetic plunger group 5A is set smaller than the upward stroke $L_2$ of the drive button 12 of the back row electromagnetic plunger group 5B, driving force of the front row electromagnetic plunger group 5A is substantially equal to that of the back row electromagnetic plunger group 5B. Accordingly, a performance can be faithfully reproduced. Especially during reproduction of weak piano sounds, since a uniform and weak key striking force (driving force) can be obtained in both the front and back rows, a piano sound reproduction area extends to the weak piano sound side, resulting in a good reproduction property. In addition, since the top end surface of the drive button 12 opposes and is parallel to the lower surface 2*a* of the key 2 at the initial position, the entire top end surface contacts the key lower surface 2*a* when the drive button 12 moves upward to drive the key 2. Therefore, the driving force of the electromagnetic plunger 5 acts perpendicularly on the key lower surface 2*a* and hence generates no component force, thereby preventing reduction in the driving force.

Figure 4:
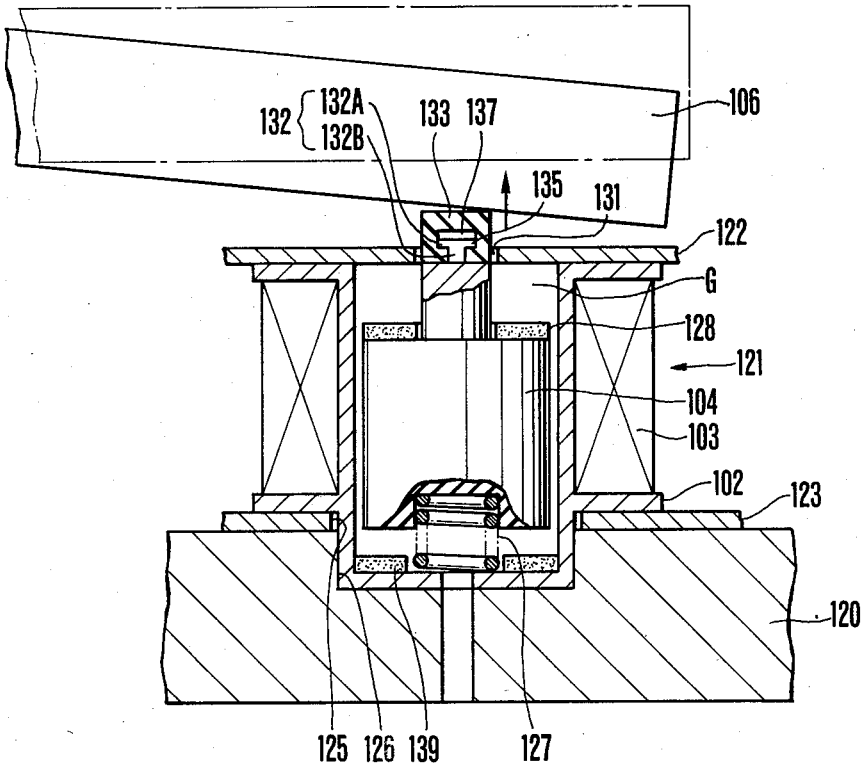
FIGS. 4 and 5 are sectional views of important parts showing a modification of the actuator according to the present invention.

FIG. 4 shows a modification of the present invention, in which an actuator 121 is disposed on the back end upper surface of a keybed 120 to correspond to the back end lower surface of a key 106.

The actuator 121 includes an upper yoke 122 and a lower yoke 123 which oppose vertically to each other, and a bobbin 102 around which a solenoid coil 103 is wound is disposed between the upper and lower yokes 122 and 123. The upper and lower yokes 122 and 123 extend along a direction perpendicular to the longitudinal direction of the key 106 so as to provide a common magnetic path for a plurality of keys 106. The lower end of the bobbin 102 is inserted into a through hole 125 provided to the lower yoke 123 and fitted in a recess 126 formed on the shelf 120. A plunger 104 is fitted slidably along the axial direction, i.e., vertically inside the bobbin 102 and elastically supported by a spring 127. A buffer member 128 such as a felt is adhered onto the upper surface of the bobbin 102, and a key drive portion 130 projects integrally at the center of the upper surface. A button locking portion 132 projects integrally at the center of the upper end surface of the key drive portion 130. The locking portion 132 is inserted into an insertion hole 131 provided to the upper yoke 122 and closely opposes to the back end lower surface of the key 106. A drive button 133 which is a characteristic feature of the present invention is detachably fitted in the button locking portion 132 from the above. The button locking portion 132 integrally has a head 132A and a neck 132B and has a substantially T-shaped cross-section. The drive button 133 is a cylinder made of an elastic material such as rubber and having an outer diameter which is substantially the same as that of the key drive portion 130. A substantially T-shaped recess 135 is formed at the center of the lower surface of the drive button 133 and receives the button locking portion 132. A depth of the recess 135 is formed larger than a thickness of the head 132A to form a hollow air gap 137. The upper end surface of the drive button 133 slightly contacts the back end lower surface of the key 106.

Note that reference numeral 139 denotes a cushion member disposed on the inner bottom surface of the bobbin 102.

In the actuator 121 having the above structure, when a signal current is supplied to the solenoid coil 103 to excite it, the plunger 104 is moved upward by a magnetic flux effect generated at a magnetic gap G between the upper and lower yoke 122 and the plunger 104, and its kinetic energy is transmitted to the key 106 through the drive button 133. As a result, the key 106 is driven as if it were pushed by a human hand.

The drive button 133 having the hollow air gap 137 is easily deformed to absorb an impact force as elastic distortion energy and as compressed energy of air inside the air gap 137. Since the drive button can be manufactured by molding and the like to obtain uniform size, shape, and elasticity, an impact characteristic at this time is very stable to contribute to stabilize an upward characteristic of the key 106.

In addition, since the outer diameter of the drive button 133 is smaller than the inner diameter of the insertion hole 131, the drive button 133 can be mounted to the plunger 104 from above the upper yoke 122, and the upper yoke 122 can be easily detached without being interfered by the drive button 133. That is, the upper yoke 122 and the drive button 133 do not interfere with each other when these members are attached or detached, resulting in good assembly workability. Furthermore, the upper and lower yokes 122 and 123 extend in common with respect to a plurality of keys 106 to reduce the number of components.

The above actuator has a simple structure, stably prevents an impact noise upon key striking, and effectively and uniformly forms the upward characteristic of the key. Therefore, the upward characteristic of the key can be improved without noise to faithfully reproduce the performance. In addition, the drive button and the upper yoke can be easily attached or detached to improve assembly workability.

Figure 5:
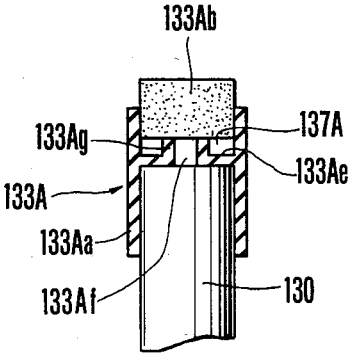

FIG. 5 shows a modification of FIG. 4 and, more particularly, a portion of the drive button 133A. The drive button 133A is constituted by a cylindrical rubber member 133Aa which is fitted into the top of the key drive portion 130 and a buffer member 133Ab such as a felt. The rubber member 133Aa has a partition 133Ae at its center, and the partition 133Ae has an opening 133Af at its center. An upward projecting edge 133Ag is provided at the periphery of the opening 133Af. Therefore, when the buffer member 133Ab is inserted from the opening 133Af of the partition 133Ae, the lower surface of the buffer member 133Ab abuts against the projecting edge 133Ag to form an air gap 137A between the lower surface and the partition 133Ae. The air gap 137A has the same effect as that of the air gap 137 of FIG. 4. Note that the outer diameter of the buffer member 133Ab is substantially the same as that of the rubber member 133Aa.

Figure 6:
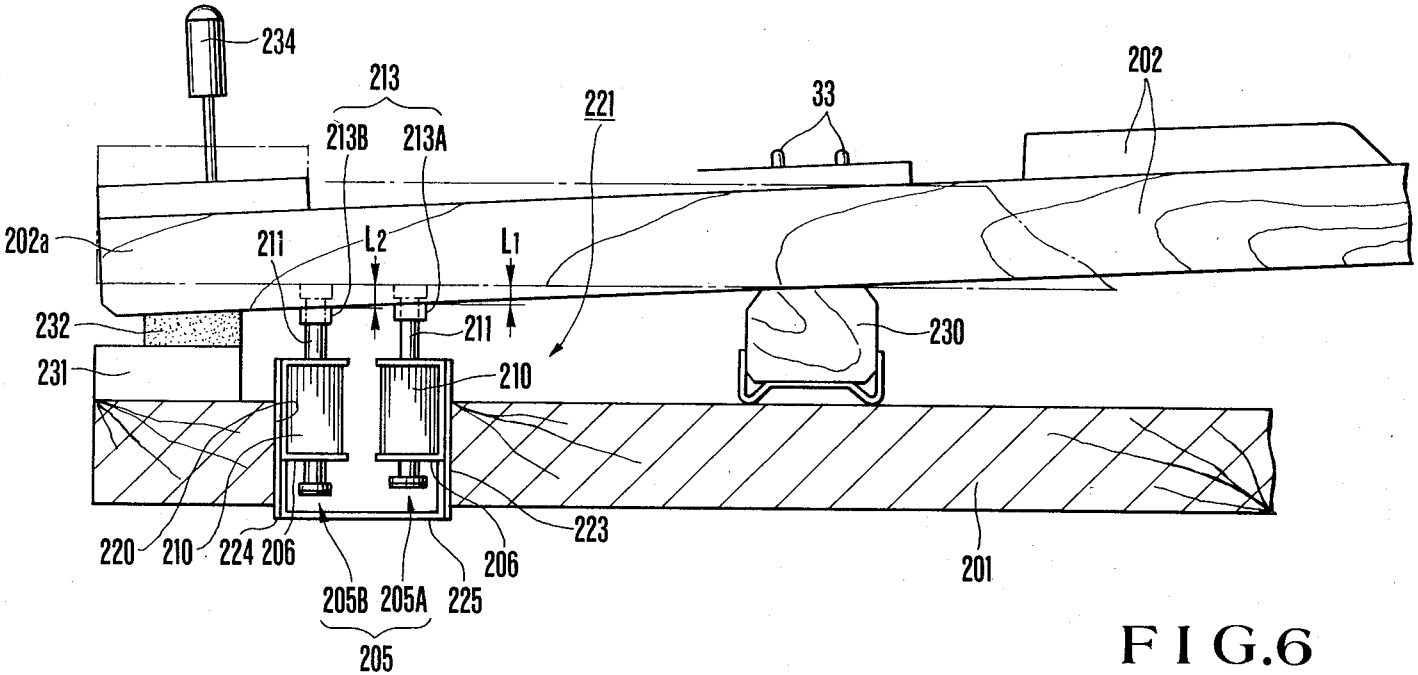
FIG. 6 is a sectional view of another modification of the actuator according to the present invention.
Figure 7:
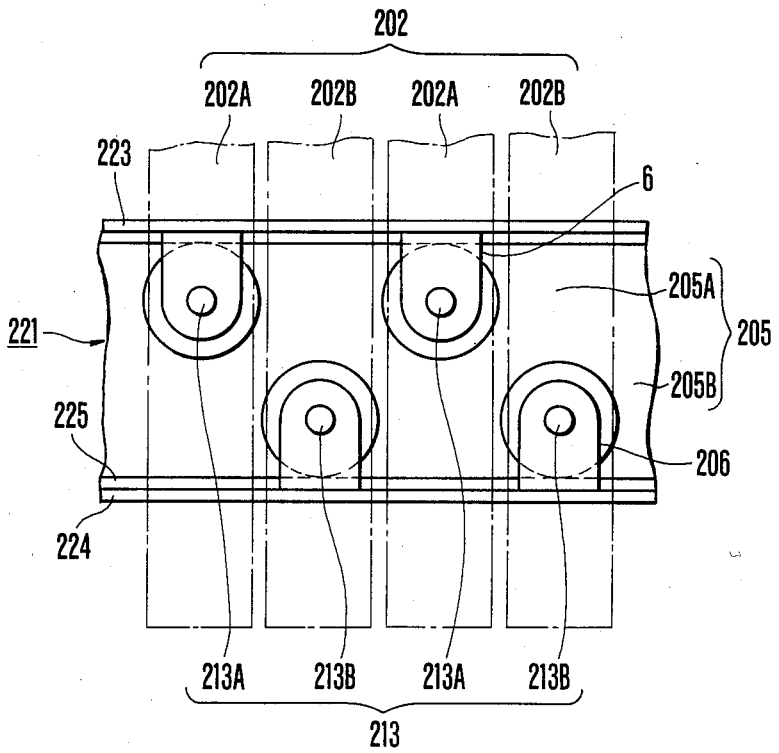
FIG. 7 is a plan view showing an arrangement of electromagnetic plungers of the modification of the actuator shown in FIG. 6.

FIGS. 6 and 7 show still another embodiment of the present invention, in which an elongated hole 220 extending along the left-right direction is formed at the back end of a shelf 201 to correspond to a back end **202*a* of the key 202, and a key drive unit 221 is disposed in the elongated hole 220**.

The key drive unit 221 is constituted by a pair of front and back mounting plates extending along the longitudinal direction of the elongated hole 220, a substantially U-shaped coupling plate 225 for connecting the lower ends of the pair of mounting plates 223 and 224, and a plurality of electromagnetic plungers 205 disposed at the inner side surfaces, i.e., the opposing surfaces, of the mounting plates 223 and 224 respectively through substantially U-shaped yokes 206. In order to assemble the key drive unit 221, the electromagnetic plungers 205 are disposed at the mounting plates 223 and 224 beforehand, and then the mounting plates 223 and 224 are integrally connected with the coupling plate 225. As shown in a plan view of FIG. 7, the electromagnetic plungers 205 are disposed in a staggered manner so as to be alternately deviated from each other in the front-back direction. For example, odd-numbered electromagnetic plungers 205A are disposed at the inner surface of the mounting plate 223 at the front side to correspond to odd-numbered keys 202A, and even-numbered electromagnetic plungers 205B are disposed at the inner surface of the mounting plate 224 at the back side to correspond to even-numbered keys 202B.

In this case, mounting heights of the electromagnetic plungers 205A and 205B at the front and back rows are substantially equal to each other. However, a height of drive buttons 213A of the front row electromagnetic plungers 205A is set higher than that of drive buttons 213B of the back row electromagnetic plungers 205B, so that intervals between the drive buttons 213 of all the plungers 205 and the key lower surface are equal to each other in the initial state. An upward stroke $L_1$ of the drive button 213A of the front row electromagnetic plunger 205A is set smaller than an upward stroke $L_2$ of the drive button 13B of the back row electromagnetic plunger 205B, so that uppermost positions of the front and back drive buttons 213 are aligned as indicated by an alternate long and short dash line in FIG. 6 and motion amounts (sinking depths of the front ends) of the keys 202 are set equal to each other. A difference between the heights of the front row drive buttons 213A and the back row drive buttons 213B is the same as a difference ($L_2-L_1$) of the upward strokes.

Note that reference numeral 230 denotes a balance rail; 231, a back rail; 232, a felt; 233, a balance key pin; and 234, a capstan. When the key 202 is depressed, it is pivoted to a substantially horizontal state. An excitation coil 210 and a movable iron core 211 constitute the electromagnetic plunger.

According to the actuator having the above arrangement, the key drive unit is very simple in structure, requires only a few components, and hence can be easily assembled and disassembled. In addition, the key drive unit is disposed inside the elongated hole 220 of the keybed 201 and hence almost does not project below the keybed, resulting in good outer appearance.

Furthermore, since the interval between the front row drive button 213A and the key lower surface is set equal to that between the back row drive button 213B and the key lower surface, the driving force of the front row electromagnetic plunger 205A can be set substantially equal to that of the back row electromagnetic plunger 205B. Therefore, the performance can be faithfully reproduced. Especially during reproduction of a weak piano sound, since a uniform and weak key punching force (driving force) can be obtained in both the front and back rows, a piano sound reproduction area extends to the weak piano sound side, resulting in a good reproduction property. In addition, the upward strokes $L_1$ and $L_2$ are different from each other to align heights at the uppermost position of the front row drive button 213A and the back row drive button 213B, so that motion amounts of all the keys 202 can be set equal to each other.

Figure 8:
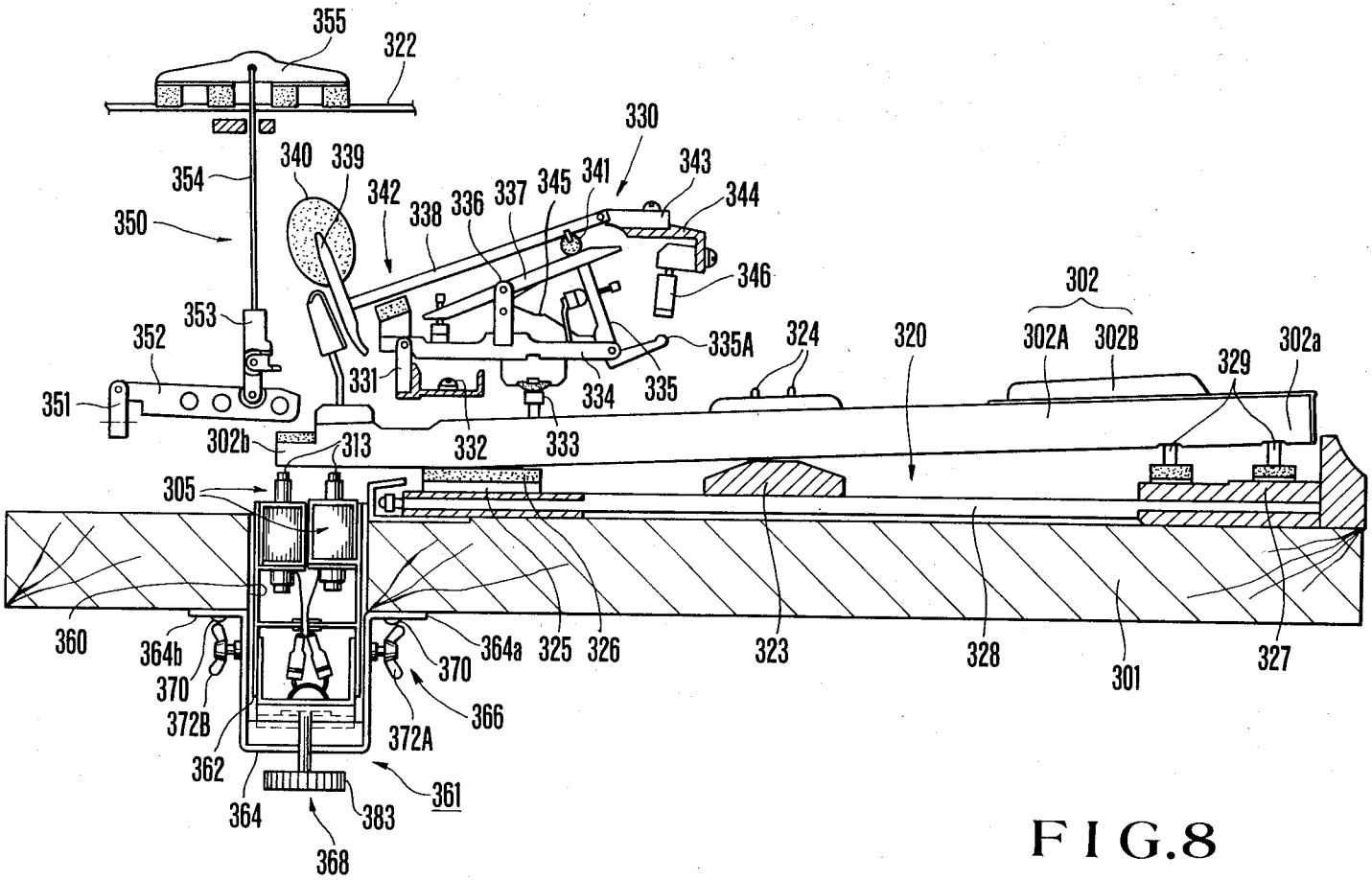
FIG. 8 is a sectional view of still another modification of the actuator according to the present invention.
Figure 9:
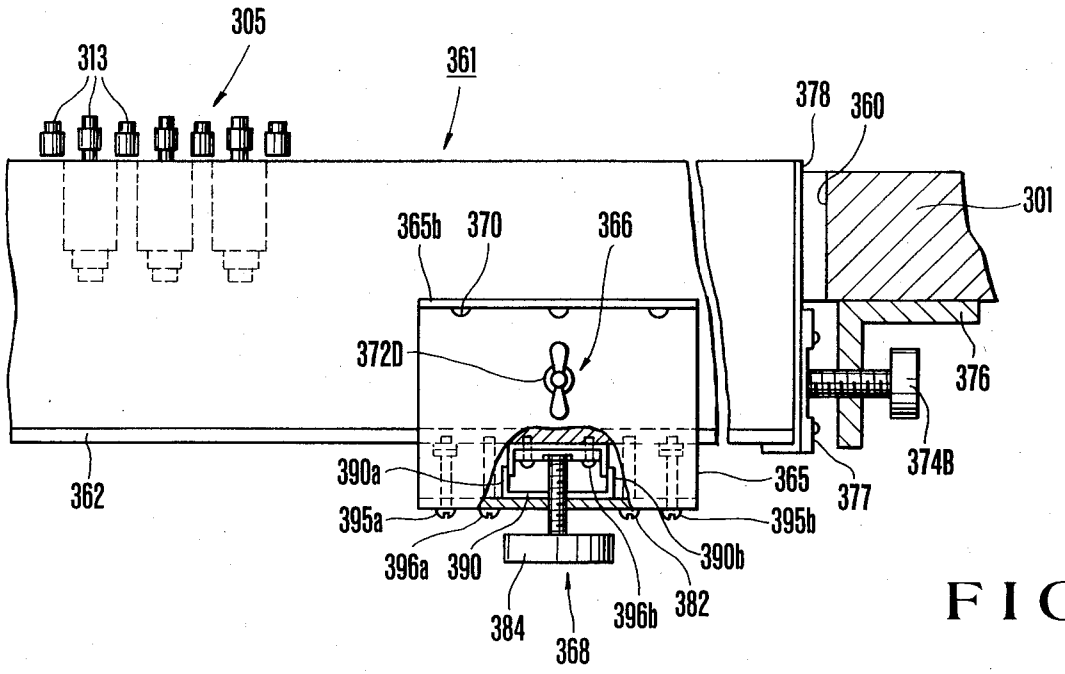
FIG. 9 is a back view showing an important part of the modification of the actuator shown in FIG. 8.
Figure 10:
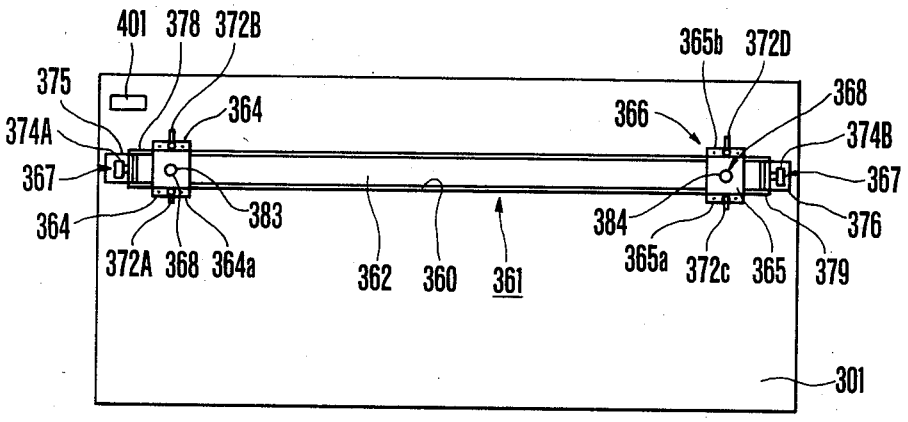
FIG. 10 is a bottom view of the modification of the actuator shown in FIG. 8.

FIGS. 8 to 10 show still another modification of the actuator according to the present invention when it is applied to an automatic performance grand piano. In FIGS. 8 to 10, a key rail 320 is mounted on a keybed 301, and keys 302 consisting of large numbers of white keys 302A and black keys 302B are disposed on the key rail 320 to correspond to strings 322 having respective pitches. Each key 302 is supported at its middle portion by a balance key pin 324 extending from a balance rail 323 so as to be vertically swingable. A front end **302*a* of the key 302 is normally floated by a load of an action mechanism 330, and the back end thereof is mounted on a back rail 325 through a felt 326. Note that the key rail 320 is formed in a lattice manner by the balance rail 323, the back rail 325, the front rail 327, a plurality of key frames 328 which integrally connects the rails 323, 325, and 327, and the like. A plurality of front rail pins 329 extend from the upper surface of the front rail 327, thereby preventing vibrations in the keys 302** along the left-right direction.

The action mechanism 330 has the same arrangement as that of a conventional action mechanism and includes a support 334, one end of which is supported by a support rail 332 to be vertically pivotable, and the free end of which is placed on a capstan screw 333 projecting from the back end upper surface of the key 302; a substantially L-shaped jack 335 which is pivotally disposed at the free end of the support 334; a vertically swingable repetition lever 337 which is disposed above the support 334 through a flange 336; a hammer 342; a spring 345 which biases (counterclockwise in FIG. 8) the jack 335 and the repetition lever 337; a regulating button 346, disposed in correspondence to a tender 335A of the jack 335, for regulating upward movement of the jack exceeding a predetermined amount; a back check 347, projecting from the back end upper surface of the key 302, for receiving the hammer 342 which pivots and returns after striking a string, and the like. The hammer 342 has a hammer shank 338, a hammer wood 339, a hammer felt 340, and a hammer roller 341. One end of the hammer shank 338 is supported by a shank rail 344 through a flange 343 to be vertically pivotable. The hammer roller 341 is normally received by the repetition lever 337.

When the key 302 is depressed and the capstan screw 333 moves upward together with the key 302 to push the support 334 upward, the support 334 pivots counterclockwise in FIG. 8 about a connecting portion with the flange 331. Then, the jack 335 moves upward together with the support 334 to push the hammer roller 341 upward, the hammer pivots upward, and the hammer felt 340 strikes the string 322. The jack 335 is prevented from any further movement in the middle of upward movement because the tender 335A abuts against the regulating button 346. The jack 335 is pivoted clockwise in FIG. 8 by a small amount of angular interval against the spring 345, so that the upper end of the jack 335 is temporarily removed from a position under the hammer roller 341. The jack 335 pivots and returns when the support 334 pivots and moves downward after the hammer 342 strikes the string 322, and the upper end of the jack 335 again moves toward the position under the hammer roller 341, thereby enabling the next string striking operation. After striking the string 322, the hammer 342 pivots and returns by gravity and by impact force of the string 322, the hammer roller 341 is received by the repetition lever 337, and the hammer wood 339 is received by the back check 347 so as not to jump up and hence returns to the initial position.

A well-known damper mechanism 350 which cooperates with the key 302 is disposed behind the key 302. The damper mechanism 350 normally prevents vibration in the string 322 and releases it during the key striking operation. The damper mechanism 350 includes a damper lever 352, the back end of which is supported by the support 351 to be vertically pivotable, and the front end of which extends above the back end of the key 302, a damper wire 354, the lower end of which is connected to the damper lever 352 through a damper block 353, and a damper 355, mounted to the upper end of the damper wire 354, for urging the string 322 from the above, so that the damper lever 352 is pushed upward by the back end of the key 302 during the key striking operation. The damper mechanism 350 is also operated by a pedal mechanism (not shown), and in this case, all the damper mechanisms are operated at the same time to release all the strings 322.

An elongated hole 360 which extends along the left-right direction is formed at the back end of the shelf 301 in correspondence to the back end **302*b*, and a key drive unit 361 is disposed inside the elongated hole 360 to be adjustable along the front-back direction, the left-right direction, and vertically. The key drive unit 361 includes a substantially U-shaped base bracket 362, which is obtained by bending a metal plate of, e.g., soft iron so as to be opened at its upper and both side surfaces and extends in common with respect to a plurality of keys 302, and a plurality of electromagnetic plungers 305, which are disposed inside the base bracket 362 to face the upper opening thereof so as to correspond to the respective keys 302. The base bracket 362 constitutes the common yoke, and a drive button 313 of each electromagnetic plunger 305 closely opposes or abuts against the back end lower surface of the corresponding key 302. In this case, the electromagnetic plungers 305 are disposed alternately deviated from each other along the front-back direction, i.e., arranged in a staggered manner, thereby preventing interference between the adjacent plungers. In the key drive unit 361, the lower portion of the base bracket 362 projects below the keybed 301 and inserted into the elongated hole 360, so that the unit 361 is supported by a pair of left and right reinforcing brackets 364 and 365 from below. The key drive unit 361 is positioned and fixed between the reinforcing brackets 364 and 365 by three adjusting mechanisms, i.e., a mechanism 366 for adjusting along the front-back direction, a mechanism 367 for adjusting along the left-right direction, and a mechanism 368 for vertical adjustment. The reinforcing brackets 364 and 365 are substantially U-shaped, and pairs of front and back mounting portions 364*a* and 364*b* and 365*a* and 365*b* provided at the upper ends thereof are fixed to the back surface of the keybed 301 by a plurality of mounting screws 370** and nuts (not shown).

The mechanism 366 for adjusting the key drive unit 361 along the front-back direction is constituted by a total of four (two pairs) adjusting screws 372A, 372B, 372C, and 372D screwed into the front and back surfaces of the brackets 364 and 365 respectively, and the distal ends of he screws 372A to 372D project inside the brackets 364 and 365 to abut against the base bracket 362. Therefore, when either the front or the back adjusting screws, e.g., the front screws 372A and 372C are sufficiently loosened beforehand and the back screws 372B and 372D are gradually tightened, the base bracket 362 is urged by the screws 372B and 372D and the key drive unit 361 is moved forward. On the contrary, when the back screws 372B and 372D are loosened beforehand and the front screws 372A and 372C are gradually tightened, the key drive unit 361 is moved backward. Thereafter, the adjusting screws 372A and 372C or 372B and 372D loosened beforehand are tightened to abut against the base bracket 362, so that the key drive unit 361 is completely prevented from being moved along the front-back direction.

The mechanism 367 for adjusting the key drive unit 361 along the left-right direction is constituted by a pair of right and left adjusting screws 374A and 374B which are provided at both sides of the unit 361 and are screwed into L-shaped metal plates 375 and 376 respectively fixed at both sides of the elongated hole 360 on the lower surface of the keybed. On the other hand, as shown in FIG. 9, side covers 378 and 379 including guide receivers 377 are respectively mounted at both side surfaces of the base bracket 362, and the distal ends of the screws 374A and 374B abut against the guide receivers 377. Therefore, similar to the case described above, when either of the adjusting screws, e.g., the screw 374A is loosened beforehand and the other screw 374B is gradually tightened, the guide receiver 377 is urged and the key drive unit 361 is moved in the left direction of FIG. 10. On the contrary, when the screw 374B is loosened beforehand and the screw 374A is tightened gradually, the key drive unit 361 is moved in the right direction of FIG. 10. By tightening the screws 374A and 374B to urge the guide receivers 377, the left-right movement of the key drive unit 361 is regulated and prevented.

The mechanism 368 for vertically adjusting the key drive unit 361 is constituted by a pair of right and left adjusting screws 383 and 384, which are respectively screwed into the centers of the lower surfaces of the brackets 364 and 365 from below, and the upper ends of which abut against the lower surface of the base bracket 362 through guide spacers 382 to be described later. When the screws 383 and 384 are rotated, they are moved forward or backward so that the key drive unit 361 is vertically adjusted.

It is a matter of course that, when the key drive unit 361 is adjusted along the front-back direction by operating the adjust mechanism 366, the key drive unit 361 must be released from the fixed state by the adjust mechanism 367. Similarly, when the key drive unit 361 is adjusted along the left-right direction by operating the adjust mechanism 367, the key drive unit 361 must be released from the fixed state by the adjust mechanism 366. In addition, when the other adjusting mechanism 368 is operated, the key drive unit 361 must be released from the fixed state by the other two adjust mechanisms 366 and 367.

A substantially U-shaped guide member 390 is fixed on the inner bottom surface of each of the brackets 364 and 365. An open portion of the member 390 faces upward, and the guide spacers 382 are fixed on the lower surface of the base bracket 362 through a guide 391 to correspond to the guide member 390. The guide 391 is formed similarly to and smaller than the guide member 390 to obtain a substantially U-shape, and fixed on the lower surface of the base bracket 362 so that its open portion faces downward. The guide 391 is inserted into the guide member 390 from the above so as to be vertically movable between left and right side walls **390*a* and 390*b* of the guide member 390. Pairs of height positioning bolts 395*a* and 395*b*, and fixing bolts 396*a* and 396*b* are respectively disposed to the brackets 364 and 365, so that the brackets 364 and 365 are temporarily fixed to the base bracket 362 by the bolts 395*a*, 395*b*, 396*a*, and 396*b***.

Figure 11:
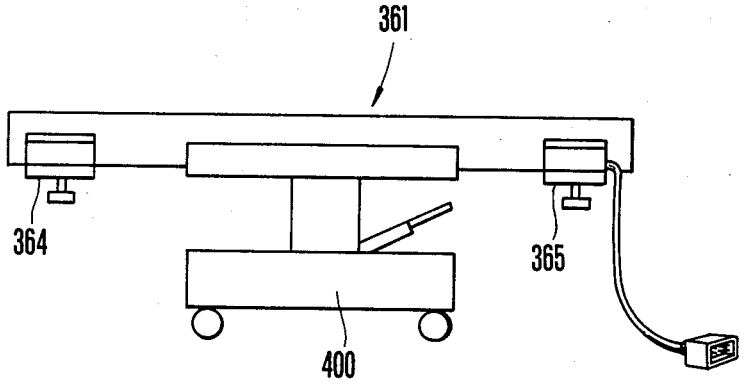
FIG. 11 is a side view of the actuator according to the present invention set on a tool.

After the pair of right and left reinforcing brackets 364 and 365 are temporarily fixed to the predetermined positions by the bolts **395*a*, 395*b*, 396*a* and 396*b*, the key drive unit 361 having the above structure is set on a key drive unit mounting tool (jack) 400, as shown in FIG. 11, and then inserted into the elongated hole 360 from below the keybed 301. Thereafter, the mounting portions 364*a*, 364*b*, 365*a*, and 365*b* of the reinforcing brackets 364 and 365 are fixed to the lower surface of the keybed 301 by the mounting screw 370, and the key drive unit 361 is adjusted along the front-back direction, the left-right direction, and vertically by the three adjusting mechanisms 366, 367, and 368 in accordance with the predetermined procedure, thereby fixing the unit 361** at the predetermined position.

Note that reference numeral 401 in FIG. 3 denotes a wooden protection block, disposed on the lower surface of the keybed 301, at a withdrawn position on the low-pitched sound side, for protecting the key drive unit 361 from an unexpected external force when the piano is raised while transporting.

As has been described above, according to the actuator having the above structure, a plurality of electromagnetic plungers 305 are arranged on the base bracket 362 beforehand at intervals each corresponding to a width of the key 302 to obtain the key drive unit 361, and the key drive unit 361 is inserted into the elongated hole 360 of the keybed 301 and adjusted along the front-back direction, the left-right direction, and vertically by the three adjust mechanisms 366, 367, and 368, so that the key drive unit 361 is reliably fixed at the predetermined position.

In addition, when the electromagnetic plungers 305 are once positioned and fixed to the base bracket 362, each electromagnetic plunger 305 need not be individually adjusted when the unit 361 is mounted, resulting in an easy assembly. Furthermore, since the adjust mechanisms 366, 367, and 368 are constituted by adjusting screws and the key drive unit 361 is moved along the desired direction by simply adjusting the screws, adjustment can be easily performed. Since the unit can be moved upward and downward as a whole, the action mechanism 330 and the keys 302 can be easily put in and taken out when the piano is tuned.

Note that, in the above embodiment, a description has been made with reference to the case in which the present invention is applied to the automatic performance grand piano. However, the present invention is not limited to the above embodiment but can be applied to an automatic performance upright piano.

In addition, in the above embodiment, the mechanism 366, for adjusting the key drive unit 361 along the front-back direction, is constituted by two pairs of, i.e., a total of four adjusting screws 372A and 372B, and 372C and 372D which are mounted to the reinforcing brackets 364 and 365, respectively, but the present invention is not limited to this. Similarly, the mechanism 368, for adjusting the key drive unit 361 vertically, is constituted by the pair of right and left adjusting screws 383 and 384, but the adjusting screws may be more than two.

Figure 12:
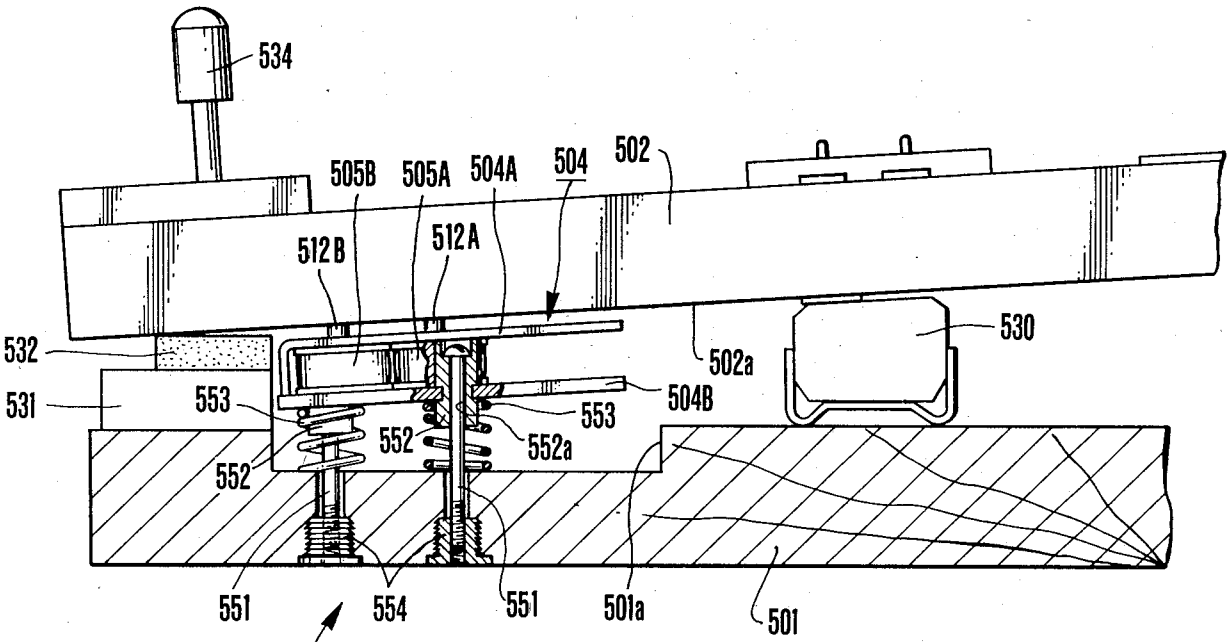
FIG. 12 is a sectional view of still another embodiment of the present invention.

FIG. 12 shows still another embodiment of the present invention. In this embodiment, a common yoke 504 is mounted to a keybed 501 so that height and inclination of the common yoke 504 can be adjusted. A plurality of electromagnetic plungers 505 are disposed between an upper plate 504A and a lower plate 504B of the common yoke 504. The electromagnetic plungers 505 have the same structure as that in FIG. 1, and are disposed to oppose to each key 502 in a direction perpendicular to the paper surface. In addition, the electromagnetic plungers 505 are divided into a front row electromagnetic plunger group 505A and a back row electromagnetic plunger group 505B in a staggered manner. In addition, as in the embodiment described above, the common yoke 504 incorporating the electromagnetic plungers 505 as in the above-mentioned manner is disposed inclined so as to oppose and to be parallel to the lower surface of the key 502 in its rest position, an interval between a drive button 512A of the front row electromagnetic plunger group 505A and a key lower surface 502*a* is set equal to that between a drive button 512B of the back row electromagnetic plunger group 505B and the key lower surface 502*a*. Structures of other portions are the same as shown in FIGS. 1 and 3, and the same parts as shown in FIGS. 1 and 3 are denoted by the same reference numerals added with 500. This embodiment is characterized by mounting a plurality of mechanisms 550 arranged in front and back rows at proper portions of the common yoke 504 which do not adversely affect the arrangement of the electromagnetic plungers 505, such that the mechanisms 550 support the common yoke 504 so as to adjust its height and inclination. Each mechanism 550 includes a screw 551, a spacer 552, a spring 553, and a fixing member 554, such as a nut, which is buried in the keybed 501. A through hole 552*a* is provided to the spacer 552 so as to lock the head of the screw 551 to pivot it. The spacer 552 includes a spacer portion which is disposed between the upper plate 504A and the lower plate 504B of the common yoke 504 to define an interval therebetween, and a stopper portion with a suitable length which extends downwardly therefrom through a hole opened in the lower plate 504B. The stopper portion defines the minimum interval between the common yoke 504 and keybed 501 to be a distance which does not pose a structural problem. The surface of the keybed 501 opposing the common yoke 504 has a recess 501*a*. A spring 553 is disposed between the bottom surface of the recess 501*a* and the lower plate 504B of the common yoke 504 so as to surround the stopper portion of the spacer 552 and the screw 551. The screw 551 is screwed through the through hole 552*a* in the fixing member 554 such as a nut which is fixed to the keybed 501 from the upper plate 504A of the common yoke 504. The screws 551 in front and back rows are selectively screwed in or out to adjust the height and inclination of the common yoke 504. Therefore, the upper surfaces of the drive buttons 512A and 512B are rendered parallel to the lower surface 502*a* of the key and the distances between each drive button and the key are made equal.

What is claimed is:

1. An actuator for an automatic performance piano, comprising electromagnetic plunger units provided in correspondence to and adjacent to a plurality of keys of the piano, each of said electromagnetic plunger units having an excitation coil and a plunger, a key drive portion, provided at the distal end of said plunger, for driving the key, said actuator characterized in that said electromagnetic plunger units are arranged along the key arrangement direction to be deviated from each other in the front-back direction of the key in a staggered manner, and that a motion stroke of said key drive portion of said electromagnetic plunger unit in one row is made smaller than a motion stroke of said key drive portion of said electromagnetic plunger unit in the other row.

2. An actuator according to claim 1, wherein an elongated hole is provided along the key arrangement direction and in correspondence to a length of the key array at the back portion of a keybed on which the keys are arranged; a key drive unit having an adjust mechanism which can be moved in the front-back direction, the left-right direction, and vertically, is housed inside said elongated hole; said key drive unit comprises a base bracket, said electromagnetic plunger units arranged and mounted on said base bracket in a staggered manner, and said adjust mechanism which can be moved in the front-back direction, the left-right direction, and vertically.

3. An actuator according to claim 2, wherein said adjust mechanism is constituted by three independent adjust means for moving said key drive unit in the front-back direction, the left-right direction, and vertically.

4. An actuator according to claim 3, wherein said adjust means for moving said key drive unit vertically comprises a U-shaped bracket, both ends of which are fixed to said keybed, and an adjusting screw, mounted to the bottom of said bracket, for moving said unit vertically.

5. An actuator according to claim 1, wherein a buffer device made of an elastic material is mounted at the distal end of said key drive portion.

6. An actuator according to claim 5, wherein an air buffer portion is provided at a connecting portion between said buffer device and said key drive portion, for absorbing impact generated when said key drive portion drives the key.

7. An actuator according to claim 6, wherein said buffer device is a cylinder having a partition therein near its center, said partition is constituted by an elastic member having a hole and a buffer member housed in the upper portion of said partition, said key drive portion is fitted into the lower portion of said partition, and said air buffer portion is provided between said partition and said buffer member.

8. An actuator according to claim 1, wherein an initial rest position of said key drive portion of each of said electromagnetic plunger units in one row is set higher by a difference of said strokes than an initial rest position of said key drive portion of each of said electromagnetic plunger units in the other row, so that an interval between the key lower surface and the top of said key drive portion of each of said electromagnetic plunger units in one row is substantially equal to that between the key lower surface and the top of said key drive portion of each of said electromagnetic plunger units in the other row.

9. An actuator according to claim 1, wherein the top surface of said key drive portion is substantially parallel to the lower surface of the key in its initial rest position.

10. An actuator according to claim 1, wherein said electromagnetic plunger units are mounted to a common yoke.

11. An actuator according to claim 10, wherein said yoke is U-shaped and a bobbin, around which an excitation coil of said electromagnetic plunger unit is wound, is disposed between an upper yoke and a lower yoke.

12. An actuator according to claim 10, wherein said yoke has an adjust mechanism for adjusting its height and inclination with respect to a keybed.

13. An actuator according to claim 12, wherein said adjust mechanism has a stopper element between said yoke and said keybed.

14. An actuator according to claim 12, wherein said yoke is mounted on said keybed by adjustable fixing screws through cushion springs.

* * * * *